United States Patent [19]

Wright

[11] Patent Number: 4,893,819

[45] Date of Patent: Jan. 16, 1990

[54] PERSONALITY TYPE BOARD GAME

[76] Inventor: Donald A. Wright, 56 Dakota Drive, Oromocto New Brunswick, Canada, E2V 1L4

[21] Appl. No.: 162,812

[22] Filed: Mar. 1, 1988

[51] Int. Cl.[4] ..... A63F 3/00

[52] U.S. Cl. ..... 273/243; 273/256

[58] Field of Search ..... 273/242, 243, 256, 273, 273/275, 249

[56] References Cited

U.S. PATENT DOCUMENTS

| | | | |
|---|---|---|---|
| 2,026,082 | 12/1935 | Darrow | 273/256 |
| 3,124,358 | 3/1964 | Weedman | 273/249 |
| 3,169,021 | 1/1961 | Bella | 273/243 |
| 3,468,540 | 9/1969 | Mulligan | 273/256 |
| 3,815,919 | 6/1974 | Cain et al. | 273/249 |
| 4,013,294 | 3/1977 | Smeda et al. | 273/243 |
| 4,124,214 | 11/1978 | Pavis | 273/243 |
| 4,216,594 | 8/1980 | Farley et al. | 273/243 |
| 4,216,971 | 8/1980 | Lyke | 273/243 |

OTHER PUBLICATIONS

Selchow & Righter, "Games", 1984, 5 pages.

Isabel Briggs Myers, *Introduction to Type,* 1982, ©1980.

Katharine C. Briggs and Isabel Briggs Myers, *Myers--Briggs Type Indicator,* ©1976, 1977.

*Primary Examiner*—William H. Grieb

*Assistant Examiner*—William E. Stoll

*Attorney, Agent, or Firm*—Rodman & Rodman

[57] ABSTRACT

A board game having as an objective the generation of information as to the personality type of the players. The players establish a personality type by answering questions the answers to which show a predisposition to one of two opposite aspects of personality. The board game has playing squares that include Feature Squares each of which is indicative of an interest or trait associated with a personality type. A player qualifies to gain a token corresponding to a Feature Square by landing on a Feature Square representing a particular interest or trait to which the player has demonstrated a predisposition by way of the player's response to questions which are indicative of personality interests or traits. The Feature Squares and matching tokens are color-coded to correspond with the questions on the cards. Preferably a Personality Type Tabulator is provided for identifying personality types as a result of the tokens gained by each player.

17 Claims, 7 Drawing Sheets

Advance to Science Fiction
Answer a choice card and receive a bonus draw if eligible

FIG. 2

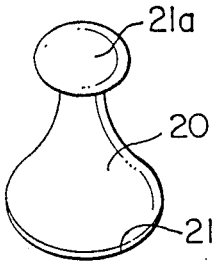

FIG. 4

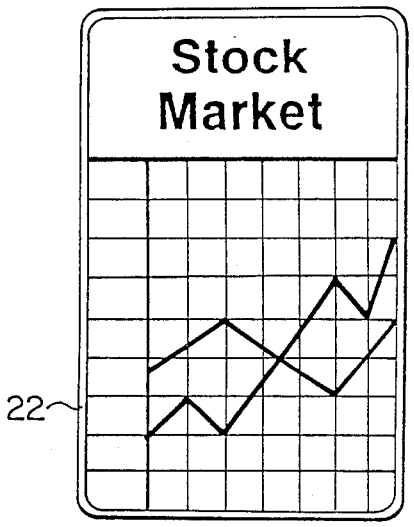

FIG. 5A

STOCK MARKET SURE THINGS

FOR THOSE WHO ARE PRACTICAL AND DOWN-TO-EARTH ABOUT THINGS AND MAINLY RELY ON THE FACTS WHEN MAKING UP THEIR OWN MIND ABOUT SOMETHING.

THIS FEATURE STYLE IS CHARACTERISTIC OF THE GAMBLER, THE ACTOR, THE ARTIST, THE JET PILOT, THE BOOKKEEPER, THE COACH, THE NURSE AND THE BANKER.

22

FIG. 5

THE GAMBLER:

Enjoy risktaking and betting on the odds. Quite flexible and like to take on more than one thing at a time. Hate doing detailed repetitive work but can usually manage to turn it into something more exciting. Love telling jokes and stories and are easygoing. Dislike long explanations yet tend to talk around an issue when unsure of themselves. Take great pride in being resourceful. Ready to 'jump in' when and where they are needed. Enjoy new and interesting challenges even if these seem totally impractical to other types. Masters of the 'dare me to do it' variety who won't very easily take 'no!' for an answer — especially if they can see an alternative way of getting around the problem. Love to 'do it' with plenty of style and are noted for their unusual approaches to things. Sports-minded but love action and doing things most of all. Will often avoid tense situations at any cost — even if it means having to totally drop out. An 'all or nothing' individual who can be extremely generous at times or very blunt. Experience difficulty in dealing with inner feelings which often tend to be satisfied physically rather than emotionally. Cheerful and outgoing in their enthusiasm for things — especially when others have even a slight tendency to let down. Willing to give extra special attention to a project if the guidelines are not too narrow. Must be free to alter their next move if they sense sudden changes. Love to 'put out fires' and are even known to start them when things are too calm. Ready to negotiate with virtually everything on the table. Confident and up front about most things yet riding an emotional roller coaster on the inside. Unpredictable — Daring and Fun.

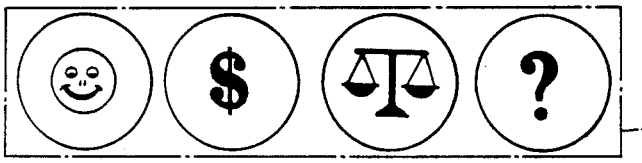

38

41

FIG. 11

PERSONALITY TYPE BOARD GAME

This invention relates to a game which generates information as to the personality types of the players.

There are numerous board games in which success is achieved according to pure chance. An object of this game is to include an element additional to pure chance including consistency of answers given to questions indicative of a personality type. In the preferred embodiment there is also a test of memory.

In many board games players are eliminated which is a social disadvantage. An objective of this game is to avoid the elimination of players. Furthermore, although consistency of personality reaction is a factor, it is an objective that no personality type has any particular advantage over the others.

SUMMARY OF THE INVENTION

These and other objectives are achieved in a board game designed to identify the personality types of the players comprising a board, a series of playing squares marked on the board including Feature Squares, each Feature Square being indicative of an interest or trait associated with a personality type, at least one token corresponding with each Feature Square, playing pieces movable along the Feature Squares of said series according to chance, means for asking questions, the answers to which show a predisposition to one of two opposite aspects of personality and qualify or disqualify a player whose playing piece lands on a Feature Square to receive said token.

The means for answering questions may, in accordance with an aspect of this invention comprise cards each having at least one question as to personality having two possible answers, with one of said answers showing a predisposition towards an aspect of personality opposite to that shown by the other of said answers.

The tokens may comprise Board Markers matching the Feature Squares and adapted to be randomly arranged on the board, said Feature Squares and matching Board Markers being colour coded to correspond to questions on the cards showing a predisposition towards an aspect of personality appropriate to the interest or trait indicated by the Feature Square.

There may be additional tokens comprising Feature Square Cards which correspond to each Feature Square.

It is advantageous to provide a Personality Type Tabulator including rows each indicative of opposite pairs of Feature Styles, each row having a neutral position, a series of positions on one side of the neutral position indicating a first Feature Style and a series of positions on the other side of the neutral position indicating a Feature Style opposite to the first Feature Style and markers to indicate the position of a player with respect to either Feature Style. The Personality Type Tabulator may include means such as depressions for holding Board Markers.

The answers on the cards may be colour coded and bear corresponding insignia to match one of the Feature Styles in a row of opposite pairs on the Personality Type Tabulator, the marker being adapted to be advanced away or towards the neutral position in the direction of a matching colour.

Personality Type Profile Cards may be provided each corresponding to the personality indicated by a series of markers gained by a player.

This invention and the manner in which the objectives are fulfilled will be further apparent from the detailed description that follows and from the appended claims.

In the drawings illustrating the preferred embodiment of this invention:

FIG. 2 is a Direction Card;

FIG. 4 is a perspective view of a playing piece;

FIG. 5 illustrates a Feature Square Card;

Figure 10:
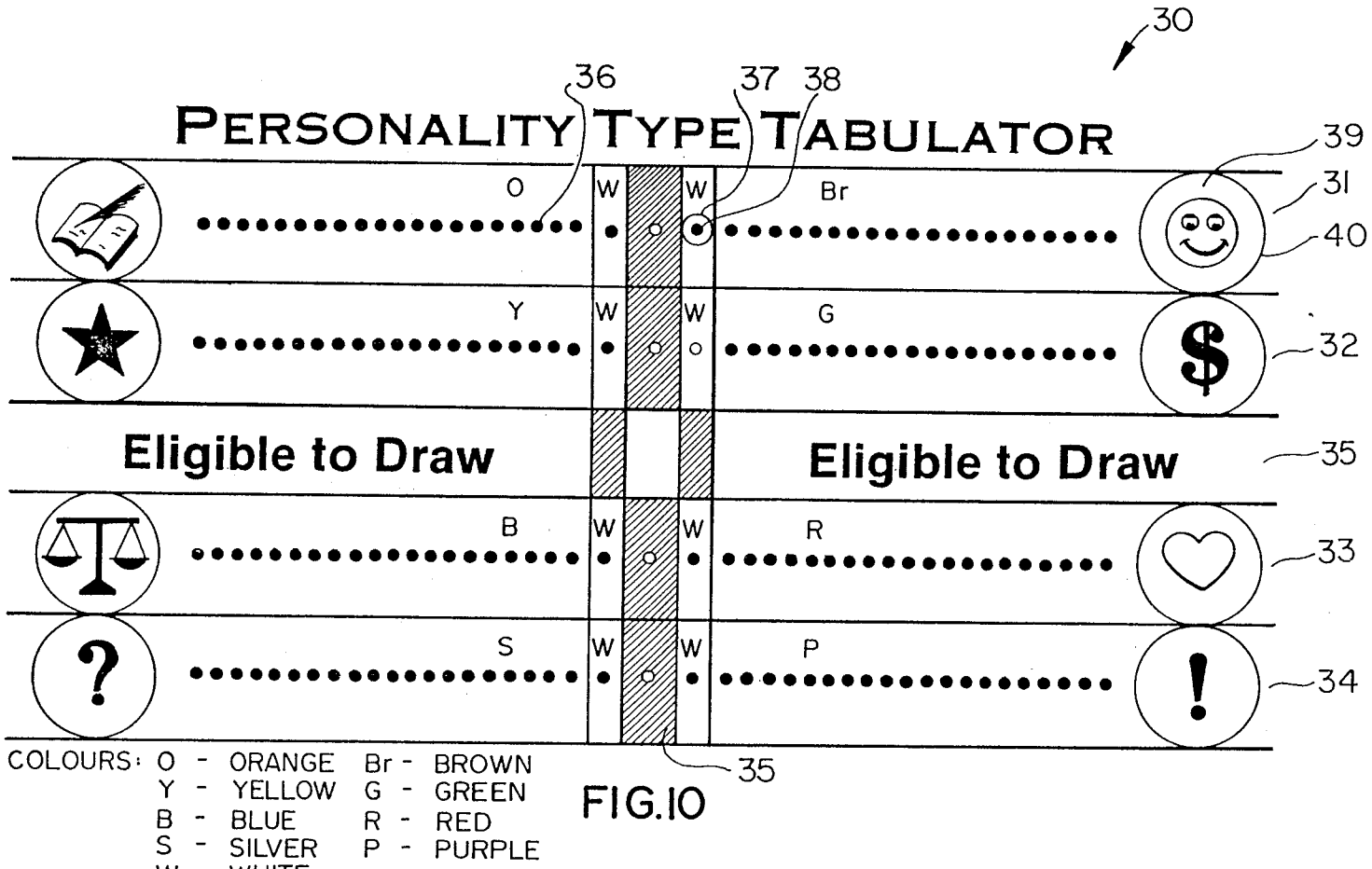

FIG. 5*a* illustrates the back of the card in FIG. 5;

FIGS. 6, 7, 8 and 9 illustrate four different types of Choice Cards;

FIG. 10 illustrates a Personality Type Tabulator;

FIG. 11 illustrates a Personality Type Profile Card;

DESCRIPTION OF PREFERRED EMBODIMENT

Figure 1:
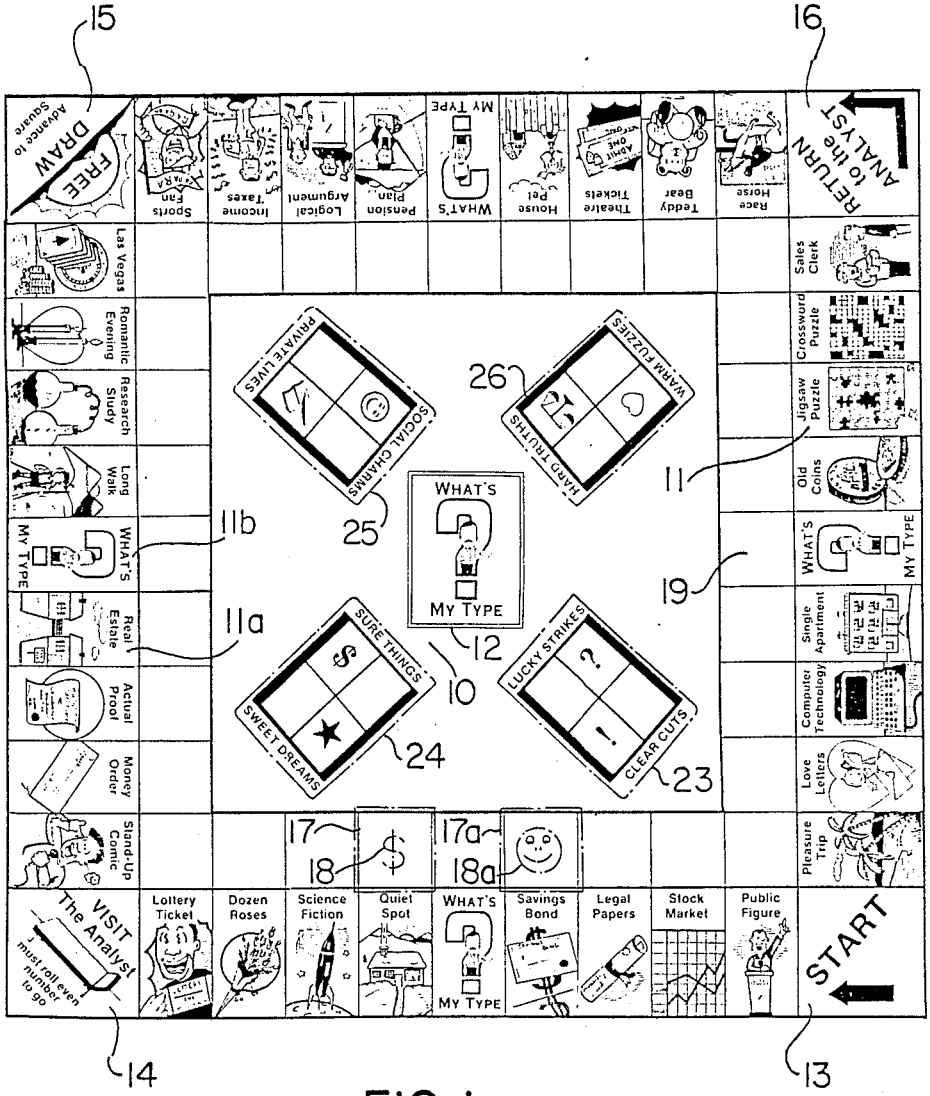
FIG. 1 is a plan view of a board for playing a game in accordance with this invention.

Referring now to the drawings;

FIG. 1 illustrates a board 10 illustrated as squares having a series of playing squares 11 located close to the edge, along each side of the board 10. Many of playing squares 11 are Feature Squares 11*a* which indicate a trait or interest associated with a particular personality type. Feature Squares are colour coded so that, for example, the Feature Squares coded with the colour purple will indicate interests appropriate for the same personality trait.

The colour codes for the Feature Squares are as follows:

| | |
|---|---|
| JIGSAW PUZZLE | Blue |
| CROSSWORD PUZZLE | Green |
| SALES CLERK | Brown |
| RACE HORSE | Silver |
| TEDDY BEAR | Red |
| ROMANTIC EVENING | Red |
| LAW VEGAS | Silver |
| RESEARCH STUDY | Yellow |
| THEATRE TICKETS | Yellow |
| HOUSE PET | Orange |
| PENSION PLAN | Purple |
| LOGICAL ARGUMENT | Blue |
| INCOME TAXES | Green |
| SPORTS FAN | Brown |
| LONG WALK | Orange |
| PLEASURE TRIP | Silver |
| LOVE LETTERS | Red |
| COMPUTER TECHNOLOGY | Yellow |
| SINGLE APARTMENT | Orange |
| OLD COINS | Purple |
| PUBLIC FIGURE | Brown |
| STOCK MARKET | Green |
| LEGAL PPERS | Blue |
| SAVINGS BOND | Purple |
| QUIET SPOT | Orange |
| SCIENCE FICTION | Yellow |
| DOZEN ROSES | Red |
| LOTTERY TICKET | Silver |
| REAL ESTATE | Purple |
| ACTUAL PROOF | Blue |
| MONEY ORDER | Green |
| STAND-UP COMIC | Brown |

The playing squares also include direction squares 11*b* which in FIG. 1 are labelled "What's My Type?". A player landing on a direction square will draw a card from the stack 12 marked "What's My Type?". FIG. 2 illustrates typical directions found on turning over card 12.

The playing squares also include at the corners a Start Square 13, a Visit The Analyst square 14, a Free Draw square 15 and a Return To The Analyst square 16. The significance of these can most conveniently be explained in connection with the Rules.

Figure 3:
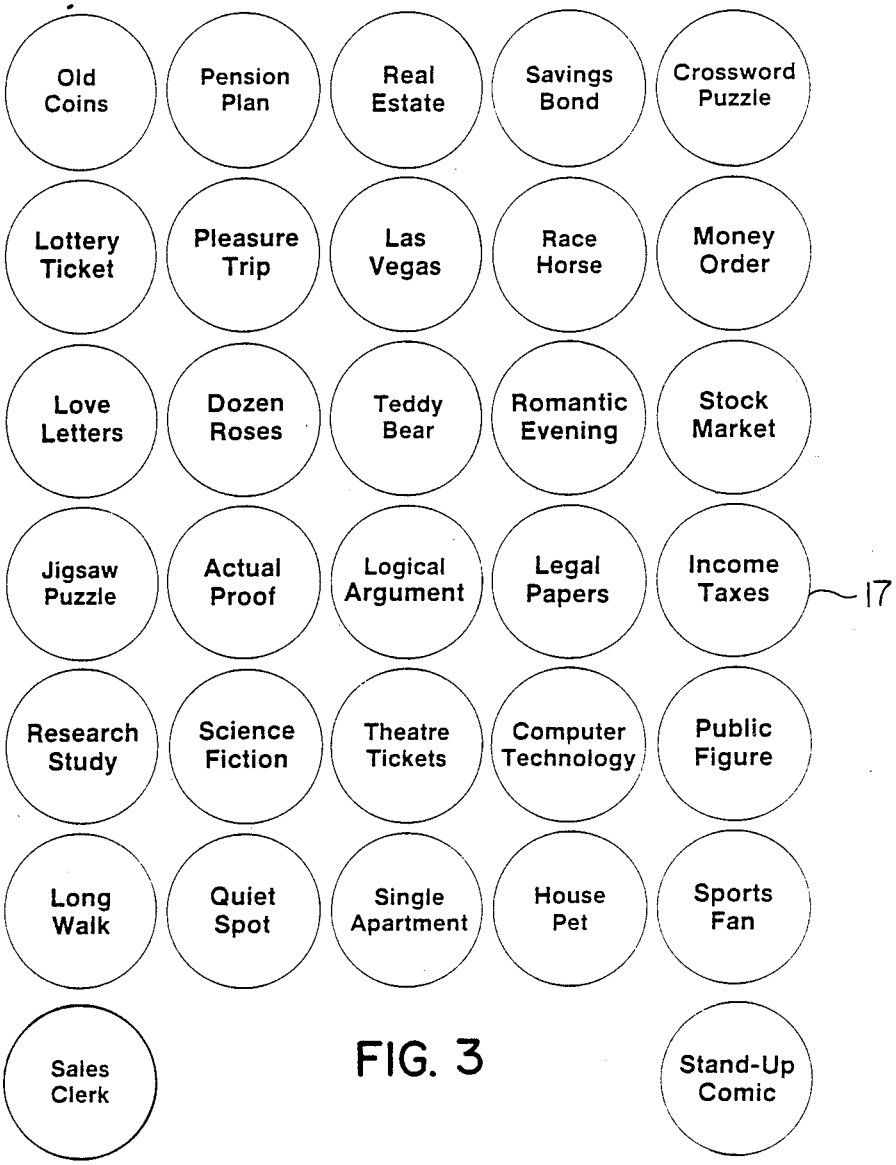
FIG. 3 is a plan view of a selection of Board Markers illustrating the notations on their bottom surfaces.
Figure 3A:
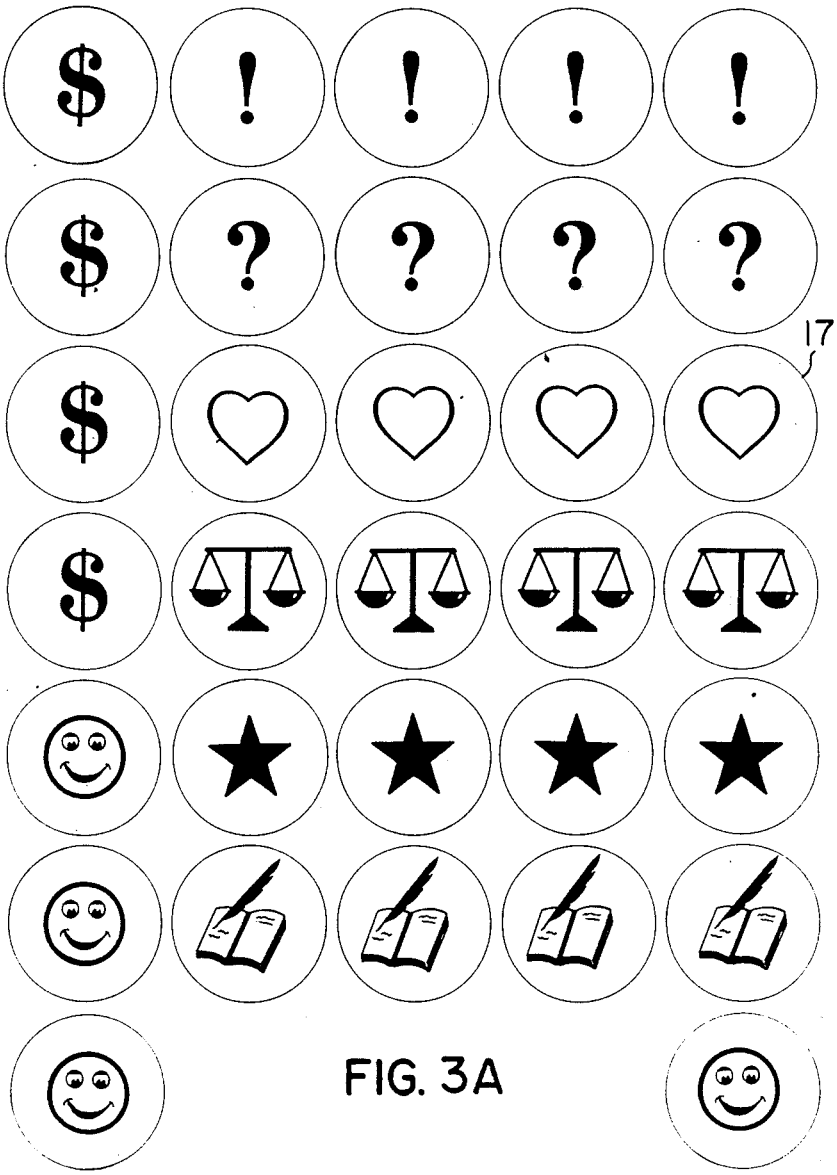
FIG. 3A is a plan view of a selection of Board Markers illustrating the insignia on their upper surfaces.
Figure 7:
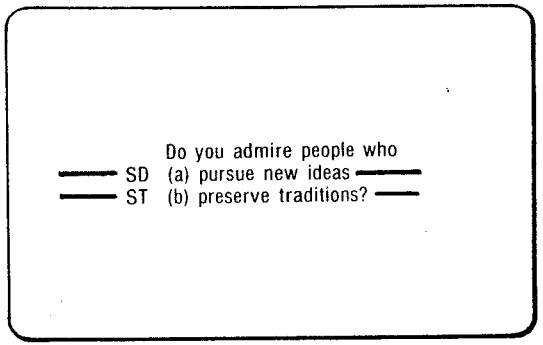

Board Markers 17 and 17*a* shown in FIG. 1 and FIG. 3*a* are typical Board Markers colour coded and bearing insignia 18 and 18*a* to indicate a category of interests or traits associated with personality types. The colour codes match those on the Feature Squares. When Board Markers such as 17 and 17*a* are turned over, they reveal one of several notations that correspond to the Feature Squares which they represent, as well as indicating an appropriate interest or trait as illustrated by FIG. 3A. Board Markers are turned down and distributed at random on squares 19 which are preferably located interiorly of the playing squares. The Board Markers act as tokens and correspond to each Feature Square.

As illustrated in FIG. 4, playing piece 20 may be of conventional design including base 21 and upper portion 21*a* that can easily be grasped.

Preferably, as illustrated by FIGS. 5 and 5*a* there are Feature Square Cards 22 which act as tokens and provide written information about the Feature Squares. The game could be played using Board Markers 17 or Feature Square Square Cards 22 as tokens, but it is best to use both. The backs of the Feature Square Cards correspond to the Feature Squares as exemplified by FIG. 5*a*.

FIG. 1 also indicates four stacks of Choice Cards 23, 24, 25, 26. Choice Cards 23 each include a question as to personality having two possible answers, with one of the answers showing an aspect of personality opposite to that shown by the other answer. Choice Cards such as those in stack 23 indicate a choice between "LUCKY STRIKES" coded silver and indicating a gambling nature; and "CLEAR CUTS" coded purple suggesting a more cautious aspect of personality.

Similarly, Choice Cards 24 contrast "SWEET DREAMS" coded yellow and "SURE THINGS" coded green. Choice Cards 25 contrast "SOCIAL CHARMS" coded brown and "PRIVATE LIVES" coded orange, and Choice Cards 26 contrast "HARD TRUTHS" coded blue and "WARM FUZZIES" coded red.

FIGS. 6, 7, 8 and 9 illustrate typical questions from Choice Cards 25, 24, 26 and 23 respectively, each answer is colour coded by means of a coloured stripe and appropriate insignia such as brown stripe 27 and orange stripe 28. The game could be played using cards with coloured designations or insignia only, but it is better if both methods of identification are used.

Figure 6:
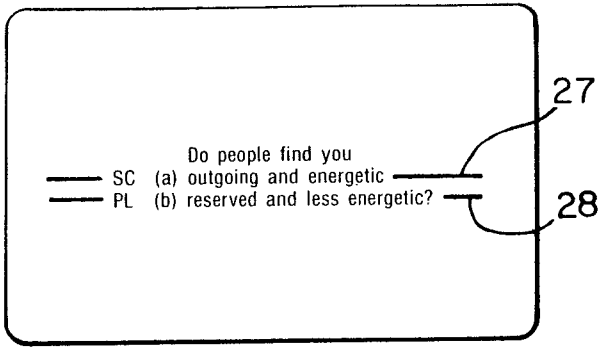
Figure 9:
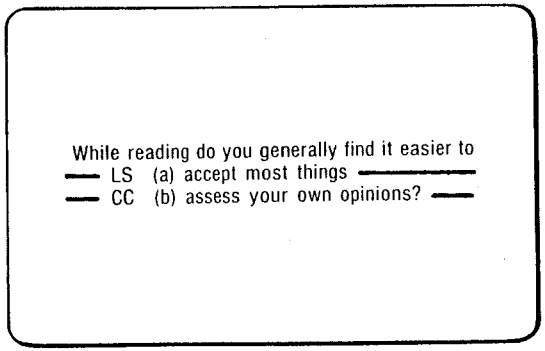
Figure 8:
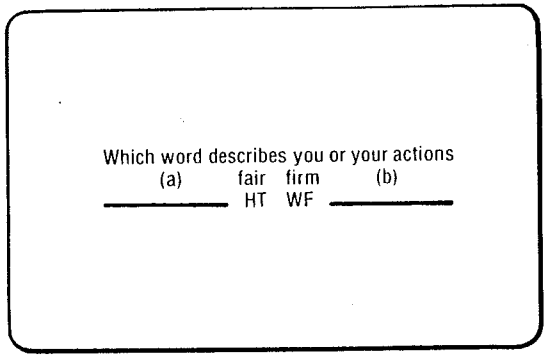

FIG. 10 illustrates a Personality Type Tabulator 30 which includes aligned rows 31, 32, 33 and 34 each indicating an opposite pair of Feature Styles that correspond to the colour coding which matches the colour stripes and insignia such as 27 and 28 on the Choice Cards. In the centre of each row there is a neutral position 35. Each row including the neutral position has holes 36 to receive pegs such as 37. If the Choice Card in FIG. 6 is, for example, answered "outgoing and energetic", peg 37 will be advanced from the neutral position to the first hole 38 in the brown "SOCIAL CHARMS" section. Depending on the player's next answer to a question from stack 25, the peg will either be returned to the neutral position or advanced to the second hole in the brown "SOCIAL CHARMS" category. As will be explained in connection with the rules, it is necessary to qualify under each Feature Style by advancing the appropriate peg from the neutral position at least one and preferably two holes to qualify to obtain tokens, namely, Board Markers 17 and Feature Cards 22. In other words, such tokens are obtained only if the player has qualified to obtain them both by having landed on the appropriate playing square, and also by having advanced the corresponding peg at least two holes in the direction matching the insignia and description on the token. The player must correctly locate the appropriate Board Marker, which will involve memory if it has been previously turned over and turned back.

Once a Board Marker has been claimed it is then located and conveniently stored in recesses 40 on the Personality Type Tabulator.

As colours cannot be illustrated on FIG. 10 a colour key is included at the bottom to identify the various colours used to designate the letters.

As will be explained in the rules, the game ends when a player has a token, such as a Board Marker in each of the four categories illustrated by the rows in FIG. 10. There are 16 possible combinations e.g. SOCIAL CHARMS, plus SURE THINGS, plus HARD TRUTHS, plus LUCKY STRIKES is one combination. The method of declaring a winner is most conveniently explained in connection with the Rules. A Personality Type Profile Card 38 as illustrated in FIG. 11 may then be provided from a selection of 16 to indicate the personality of the declared winner as indicated by the colour coded Feature Style combination on the Personality Type Tabulator, being the same as at 41 on FIG. 11.

We will now present the preferred playing directions and rules from which variations may be made within the scope of the appended claims.

HOW TO PLAY WHAT'S MY TYPE? (WHAT'S MY TYPE? is a proposed trademark).

The aim of What's My Type? is to answer questions which enable you to learn more about your personality type. The game is played by 2 to 6 people throwing dice and moving playing pieces around the board in a clockwise direction. When a playing piece lands on a Feature Square, the player answers a corresponding Choice Card.

Two answers are provided on the Choice Card and the player picks whichever one is closer to his or her usual way of doing things. The answers to these questions correspond to various Features Styles which typify how people ordinarily look at things and make decisions. The Personality Type Tabulators are used to keep track of each player's responses to the Choice Cards.

There are four pairs of opposite Feature Styles portrayed along the game board. A player's personality type consists of the Feature Styles that are indicated by the Personality Type Tabulator. A player who lands on a Feature Square which matches any one of the preferred Feature Styles in his or her personality type has a chance to claim the Feature Square.

The object of WHAT'S MY TYPE? is to be the first player who claims one Feature Square for each of the four Feature Styles in his or her personality type.

WHAT'S MY TYPE? cards add some rather interesting moments to the game and there is always the unexpected opportunity to Visit The Analyst. There are no right or wrong answers to any of the questions on the Choice Cards. None of the players are ever eliminated from the game and no personality type has any particular advantage over the rest.

EQUIPMENT

The equipment consists of the game board, a pair of dice, six playing pieces, six Personality Type Tabulators; twenty-four Feature Style Point Pegs, thirty-two Feature Square Cards, 32 Board Markers; four sets of Choice Cards, sixteen WHAT'S MY TYPE? Profile Cards, and a deck of WHAT'S MY TYPE? Cards.

BEFORE PLAY BEGINS

Shuffle each deck of cards separately and place them face down on the game board in their marked spots. Randomly place the thirty-two Board Markers face down along the inner squares on the game board. No player should know the position of any Board Marker before the start of the game. Each of the players selects a playing piece to represent his or her position on the game board and receives a Personality Type Tabulator along with four Feature Style Point Pegs. The remaining equipment is looked after by a player who is selected to be the Analyst.

PERSONALITY TYPE TABULATOR

The Personality Type Tabulators are used to keep a running total of each player's responses to the questions from the Choice Cards. Each of the four horizontal columns on the Personality Type Tabulator contains a pair of opposite Feature Styles (example: PRIVATE LIVES and SOCIAL CHARMS).

When a player answers a question, the corresponding Feature Style Point Peg is moved one hole (along the horizontal column) in the direction of the Feature Style identified on the Choice Card.

The Feature Style Point Pegs may be moved in either direction and from one Feature Style to the other. The positions of the four Feature Style Point Pegs identify the preferred Feature Styles in a player's personality type. The middle holes are the starting positions for the Feature Style Point Pegs and are referred to as neutral positions.

When a player correctly draws a matching Board Marker and claims a Feature Square—the Board Marker is then positioned in the correct holder on the Personality Type Tabulator.

TO BEGIN PLAY

Every player selects a playing piece and positions it on the Start Square. The players roll the dice to determine who will start first. The player with the highest roll begins the game. He or she rolls the dice and moves his or her playing piece according to the number shown on both dice. Playing pieces always move in a clockwise direction around the outer squares on the game board.

Upon completion, the turn passes to the player on the left. Playing pieces remain in their location until the player's next turn—unless another player lands on the same square.

Only one playing piece may occupy the same square on the board at one time (except Visit The Analyst).

When a player lands on a square already occupied, the first playing piece to land there goes to Visit The Analyst.

LANDING ON A GAME BOARD SQUARE

Each time a playing piece lands on a game board square there are several possible options; a player may be eligible to draw, answer a Choice Card, take a WHAT'S MY TYPE? card, earn a free draw, receive an extra turn, or return to Visit The Analyst. When a player rolls doubles three times in a row, the playing piece goes immediately to Visit The Analyst—unless the player happens to land on Start.

LANDING ON START

A player receives an extra turn for landing on Start. Landing on Start also cancels the number of doubles that a player may have rolled to reach the square.

LANDING ON AN UNCLAIMED FEATURE SQUARE

The Feature Squares portray the various Feature Styles which combine to identify a player's personality type. Descriptions for each Feature Style are printed on the Feature Square Cards. Whenever a player lands on a Feature Square, he or she must first answer a Choice Card question. The players may decide who will ask each question. A player is not entitled to ask himself or herself a Choice Card question.

Feature Squares remain unclaimed until a player who is eligible to draw lands there and correctly draws the matching Board Marker.

A draw consists of turning a Board Marker completely face up for all to see.

To be eligible for a draw, a player must have a minimum of two Feature Style points (as shown by the coloured portion on the Personality Type Tabulator) for the style portrayed on the Feature Square. For example: a player with two or more Feature Style points for LUCKY STRIKES who lands on RACE HORSE, LAS VEGAS, PLEASURE TRIP, or LOTTERY TICKET is eligible to draw.

After a player draws a Board Marker it is either returned face down to its original position or placed in the Personality Type Tabulator—if it matches the Feature Square.

A player may claim only one Feature Square at a time from any Feature Style pairing. At all times, the Board Markers in the Personality Type Tabulator must correspond to the Feature Styles indicated by the positions of the Feature Style Point Pegs. If one of the player's Feature Style preferences becomes neutral, he or she must remove the Board Marker from the Personality Type Tabulator and return it along with the Feature Square card to the Analyst.

LANDING ON A CLAIMED FEATURE SQUARE

There is no penalty for landing on another player's Feature Square. However, in place of the draw, a player (who is eligible to draw) may challenge the owner for the right to claim the square. When this happens, the two players must throw the dice to see who will keep the Feature Square and Board Marker. If the owner rolls doubles he or she wins, otherwise, the player who rolls the higher number keeps the square. A tie goes to the owner. The one who loses the challenge must return to Visit the Analyst.

LANDING ON WHAT'S MY TYPE?

When a playing piece lands on WHAT'S MY TYPE? the player takes the top card from the deck and upon completing the directions, returns the card face down to the bottom of the deck. The card marked "Excused from Visiting the Analyst" may be kept by the player until needed. After it is used it must be returned to the bottom of the deck.

Cards which require the player to answer a Choice Card entitle the player to select the category of the card.

"Return to Visit the Analyst" is the only card which causes a player to lose his or her next turn.

LANDING ON FREE DRAW

A player who lands on Free Draw must draw from any available Board Marker and proceed directly to the Feature Square, position the Board Marker in his or her Personality Type Tabulator, and then receive a Choice Card question. If the player is not eligible to draw a Board Marker, when he or she lands on Free Draw, then his or her playing piece remains on the square and his or her turn ends.

LANDING ON RETURN TO VISIT THE ANALYST AND VISIT THE ANALYST

If a playing piece lands on or is sent to Visit The Analyst, the player is required to remain on the square until he or she rolls an even number with the dice. There is no other means of leaving the square except by using a WHAT'S MY TYPE? "exemption" card before rolling the dice.

If a player throws doubles and lands on Visit The Analyst, he or she is not entitled to roll again and the turn passes to the next player.

THE ANALYST

At the start of play, a player is selected to be the Analyst for the entire game. The Analyst acts as the controller for the Feature Square Cards, Board Markers, and WHAT'S MY TYPE? Profile Cards. When a Feature Card is claimed, the Analyst issues the player with the Feature Square Card.

When a player forfeits a Feature Square, he or she returns the Feature Square Card and Board Marker to the Analyst. Next, the Analyst takes all of the corresponding Board Markers that are unclaimed (including the one being returned) and randomly repositions them so that no player knows their new locations.

THE END OF THE GAME

The game is over when the first player has claimed one Feature Square for each Feature Style in his or her personality type.

At this point the player immediately returns his or her playing piece to Visit The Analyst. The player is then asked one question from each of the four Choice Card decks to confirm the player's personality type.

The player is not entitled to learn either the category of the Choice Card being answered or the Feature Style represented by his or her response—until all four answers have been given.

The player must forfeit to the Analyst any Feature Square which did not match the response given to the corresponding Choice Card and play continues.

The player who successfully defends his or her personality type in this manner receives the appropriate WHAT'S MY TYPE? Profile Card from the Analyst, after it has been read aloud to all of the players. The corresponding WHAT'S MY TYPE? Profile Card is easily identified by matching the colours on the card with those on the Board Markers in the Personality Type Tabulator.

The embodiments of the invention in which an exclusive property or privilege is claimed are defined as follows:

1. A board game designed to identify the personality type of the players comprising, a board, a series of playing squares marked on the board including Feature Squares, each said Feature Square being indicative of an interest of trait associated with a personality type, a plurality of tokens, said tokens comprising board markers which match the Feature Squares and include data that is turned down so as to be concealed, adapted to be randomly arranged on the board, whereby the player requires an element of luck where the token has not previously been turned and a retentive memory where the token has previously been turned, to enable a player to obtain possession of the token appropriate to his personality, said Feature Squares and matching ones of said Board Markers being colour coded to correspond to questions on the cards, the answers to which indicate a predisposition towards an aspect of personality appropriate to one of either of two possible interests or traits, each said token corresponding with each said Feature Square, playing pieces movable along the Feature Squares of said series according to chance, means for asking questions comprising cards each having a question as to personality having two possible answers, with one of said answers showing a predisposition towards an aspect of personality opposite to that shown by the other of said answers and qualifying or disqualifying a player whose playing piece lands on the Feature Square to receive said token.

2. A board game as in claim 1, in which the movement of the playing pieces is controlled by the roll of the dice.

3. A board game as in claim 1 in which said at least one token comprises a Feature Square Card corresponding to each Feature Square.

4. A board game as in claim 1 in which the playing squares include positions where a player is required to draw a card giving directions as to actions required of the player.

5. A board game designed to identify the personality type of the players comprising, a board, a series of playing squares marked on the board including Feature Squares, each said Feature Square being indicative of an interest or trait associated with a personality type, at least one token corresponding with each said Feature Square, playing pieces movable along the Feature Squares of said series according to chance, means for asking questions comprising cards each having a question as to personality having two possible answers, with one of said answers showing a predisposition towards an aspect of personality opposite to that shown by the other of said answers and thereby qualifying or disqualifying a player whose playing piece lands on the Feature Square to receive said token, a Personality Type Tabulator including rows each indicative of opposite pairs of Feature Styles, each said row having a neutral position, a series of positions on one side of the neutral position indicating a first Feature Style, along with the capability of storing the corresponding token for said Feature Style, and a series of positions on the other side of the neutral position indicating a second Feature Style opposite to the first Feature Style, along with the capability of storing the corresponding token for one of said Feature Styles, and markers to indicate the position of a player with respect to either of said Feature Styles and thereby qualifying or disqualifying a player to receive a said token.

6. A board game as in claim 5 comprising board markers matching the Feature Squares and adapted to be randomly arranged on the board, as well as, stored on each player's Personality Type Tabulator when acquired by a player.

7. A board game as in claim 5 in which the answers on the cards are colour coded and bear the insignia of a particular Feature Style from a pair of opposite Feature Styles matching the corresponding row on the Personality Type Tabulator, the marker being adapted to be advanced away or towards the neutral position in the direction of a particular Feature Style matching the coloured insignia on the card.

8. A board game as in claim 1 in which the playing squares extend adjacent to the four edges on each side of the board and in which there are positions for the board markers to be randomly located interiorly of the playing squares.

9. A board game as in claim 8, in which positions for a plurality of said sets of cards, each having a minimum number of at least one question as to personality are located interiorly of the positions of the Board Markers.

10. A board game as in claim 9, additionally including a position interiorly located for a set of cards giving directions as to actions required of a player who lands on a playing square that requires the player to pick a card from the last mentioned set of cards.

11. A game designed to identify the personality types of the players comprising a Personality Type Tabulator including rows, each indicative of opposite pairs of Feature Styles, each row having a neutral position, a series of positions on one side of the neutral position indicating a first Feature Style along with the capability of storing a token which is representative of the Feature Style and a series of positions on the other side of the neutral position indicating a Feature Style opposite to the first Feature Style along with the capability of storing a token which is representative of the Feature Style, markers to indicate the position of a player with respect to either of the Feature Styles and a plurality of sets of cards each having a question as to personality having two possible answers, with one of the said answers showing a predisposition towards said first Feature Style and the other of said answers showing a predisposition towards the opposite Feature Style, the position of the markers being adapted to be adjusted in the direction of the Feature Style indicated by the answers to questions, and tokens added to said means for storing tokens only when the markers are a predetermined distance away from the neutral position.

12. A game as in claim 11 in which the Feature Styles and answers are colour coded to match those Feature Styles with the answers that are indicative of such Feature Styles.

13. A game as in claim 12 comprising tokens indicative of an interest or trait associated with a personality type, said tokens being colour matched to the Feature Style and answers appropriate to such interest or trait.

14. A game as in claim 13 comprising a board, positions on the board qualifying a player who reaches such position to obtain a token provided also that the position of a marker on the Personality Type Tabulator qualifies the player to obtain such token.

15. A game as in claim 14 comprising Personality Type Profile Cards, each corresponding to the personality indicated by a series of tokens gained by a player and stored.

16. A game as in claim 15, wherein the tokens are stored in recesses on the Personality Type Tabulator.

17. A game as in claim 14 in which said tokens are randomly located on the board and include data that is turned down so as to be concealed, whereby the player additionally requires an element of luck, where a token has not previously been turned, and a retentive memory where the token has previously been turned, to enable the player to obtain possession of a token appropriate to his personality.

* * * * *